US006176734B1

(12) United States Patent
Juntwait et al.

(10) Patent No.: US 6,176,734 B1
(45) Date of Patent: Jan. 23, 2001

(54) TRANSITION CABLE ASSEMBLY

(75) Inventors: Eric Juntwait, Irvine; George Lee, Taipei; David Tso-Chin Ko, Thousand Oaks, all of CA (US)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/252,545

(22) Filed: Feb. 19, 1999

(51) Int. Cl.[7] ..... H01R 3/00; H01R 12/00; H01R 1/00

(52) U.S. Cl. ..... 439/493; 439/67

(58) Field of Search ..... 439/425, 499, 439/492, 493, 67

(56) References Cited

U.S. PATENT DOCUMENTS 3,701,964 * 10/1972 Cronin ..... 339/17 F
3,772,776 * 11/1973 Wiesenburger ..... 29/628
4,602,840 * 7/1986 Romatzick ..... 339/97 P
5,007,856 * 4/1991 Puerner ..... 439/452
5,389,741 * 2/1995 Ueno ..... 174/117 F
5,669,775 * 9/1997 Campbell et al. ..... 439/77

* cited by examiner

*Primary Examiner*—Brian Sircus
*Assistant Examiner*—Chandrika Prasad
(74) *Attorney, Agent, or Firm*—Wei Te Chung

(57) ABSTRACT

A transition cable assembly comprises a flexible circuit having a connecting portion at one end and a socket connector at another end for mating with a complimentary connector. The flexible circuit defines at least a hole adjacent to the connecting portion. A strain relief is assembled to the flexible circuit adjacent to the hole thereby preventing the flexible circuit from breaking around the hole.

3 Claims, 5 Drawing Sheets

TRANSITION CABLE ASSEMBLY

FIELD OF THE INVENTION

The present invention relates to a cable assembly, and more particularly to a cable assembly having a strain relief.

DESCRIPTION OF THE PRIOR ART

Conventionally, I/O connectors used with hard disk drives have 26 pins while control cards used therewith have 28 pins. In order to establish an electrical connection therebetween, a transitional printed circuit board is introduced. The printed circuit board is assembled to the hard disk drive and includes an array of 28 pins header on one edge for connection with a 28 pin header socket attached to a flat flexible cable and a 26 pins FFC connector on another edge for connection with a built-in FFC connector by means of a FFC cable generally called jumper. The header pins are electrically connected to corresponding contacts of the FFC connector by means of leads formed on the printed circuit board whereby two header pins are bypassed. Since both the FFC connector and the header pins are soldered to the printed circuit board, the manufacturing cost increases accordingly.

A solution addressed to this issue provides a flexible circuit having a connecting portion at one end and a socket connector at another end. The flexible circuit has two holes adjacent to the connecting portion for extension of locking screws retained to the hard disk drive. Even the soldering process is eliminated, the flexible circuit is vulnerable to break around the rim of the holes because a stress concentration will be raised when the locking screws are assembled.

SUMMARY OF THE INVENTION

An objective of this invention is to provide a transition cable assembly having a strain relief thereby preventing a flexible circuit from breaking.

In order to achieve the objective, a transition cable assembly in accordance with the present invention comprises a flexible circuit having a connecting portion at one end and a socket connector at another end for mating with a complimentary connector. The flexible circuit defines at least a hole adjacent to the connecting portion. A strain relief is assembled to the flexible circuit adjacent to the hole thereby preventing the flexible circuit from breaking around the hole.

These and additional objects, features, and advantages of the present invention will become apparent after reading the following detailed description of the preferred embodiment of the invention taken in conjunction with the appended drawings.

DETAILED DESCRIPTION OF PREFERRED EMBODIMENT

Figure 1:
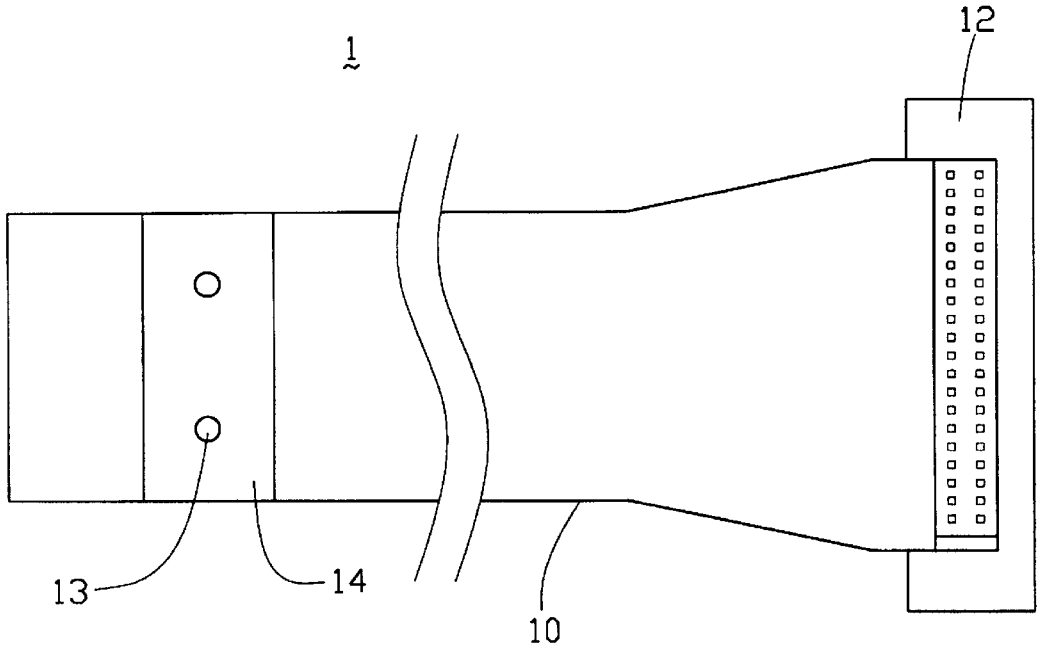
FIG. 1 is a top plan view of a transition cable assembly in accordance with a first embodiment of the present invention.
Figure 2A:
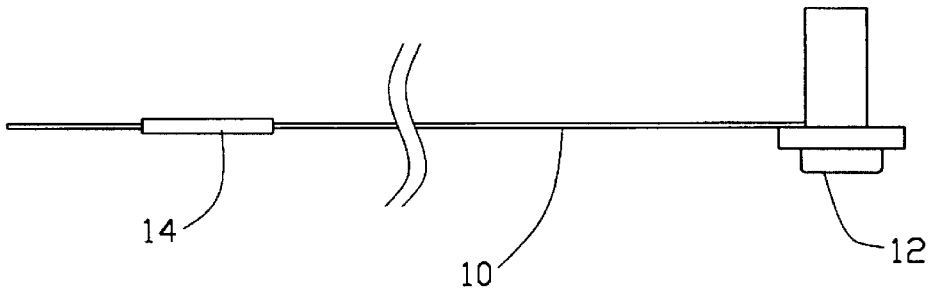
FIG. 2A is a side view of FIG. 1.
Figure 2B:
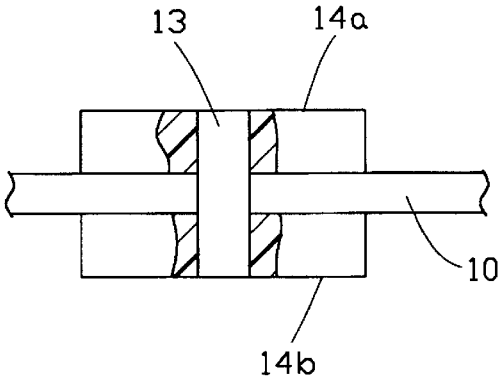
FIG. 2B is an enlarged view encircled in FIG. 2A.
Figure 3:
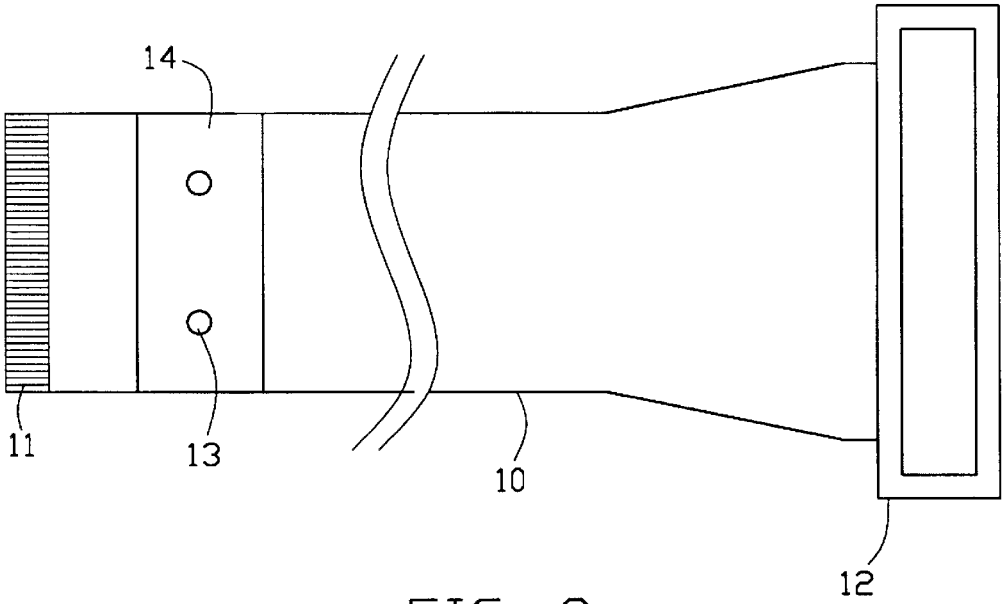
FIG. 3 is a bottom view of FIG. 1.
Figure 4:
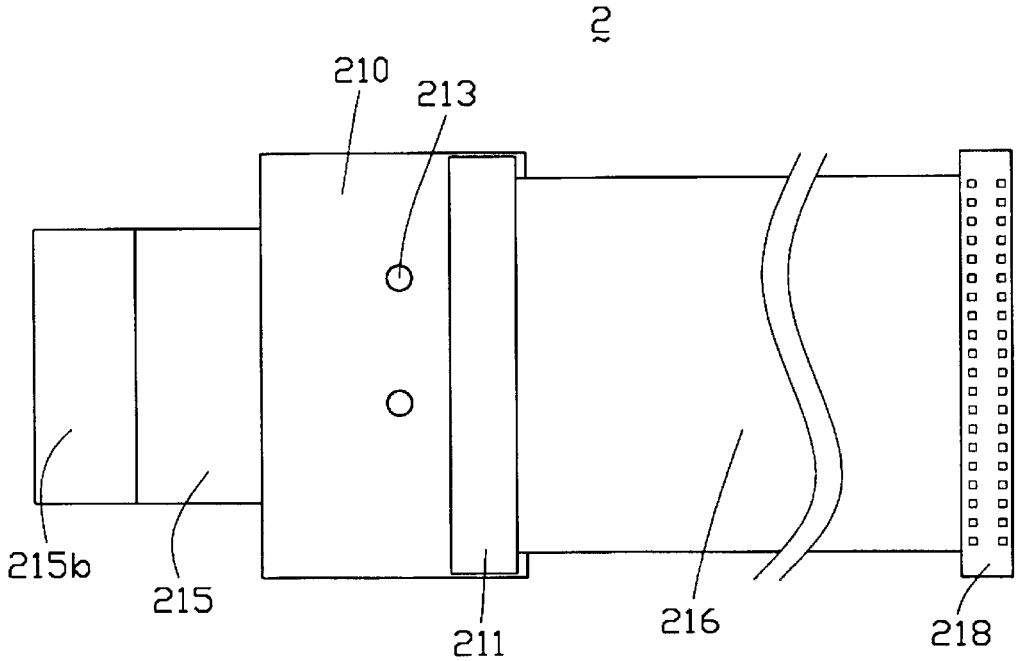
FIG. 4 is a top plan view of a transition cable assembly in accordance with a second embodiment of the present invention.
Figure 5:
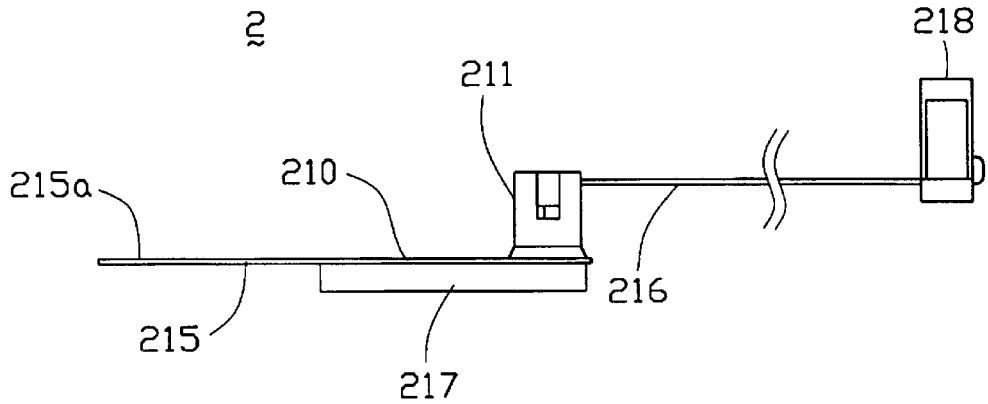
FIG. 5 is a side view of FIG. 4.
Figure 6:
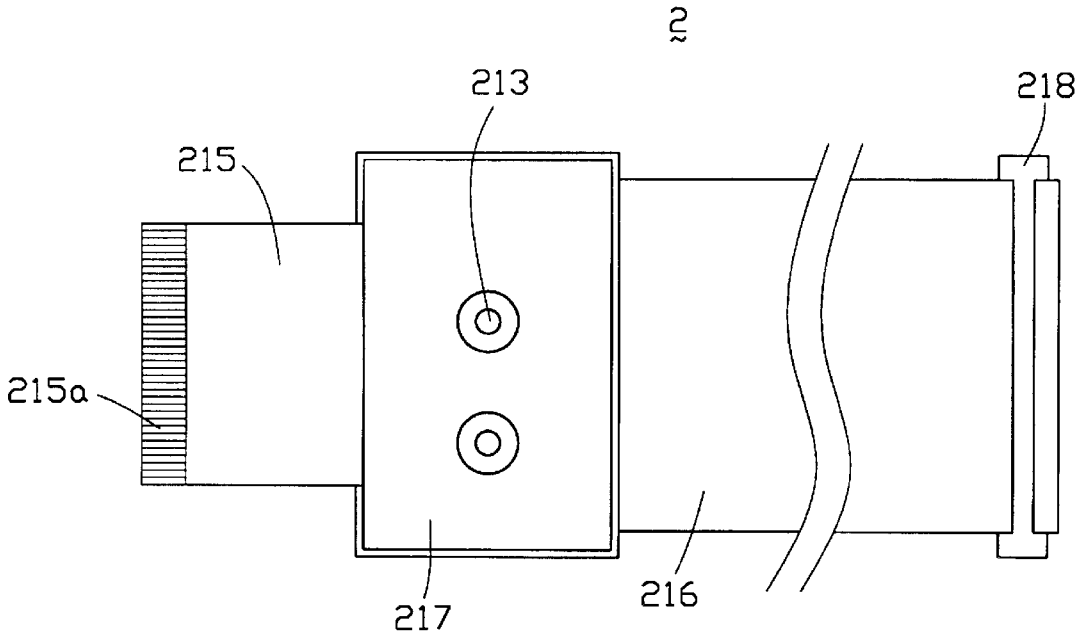
FIG. 6 is a bottom view of FIG. 4.
Figure 7:
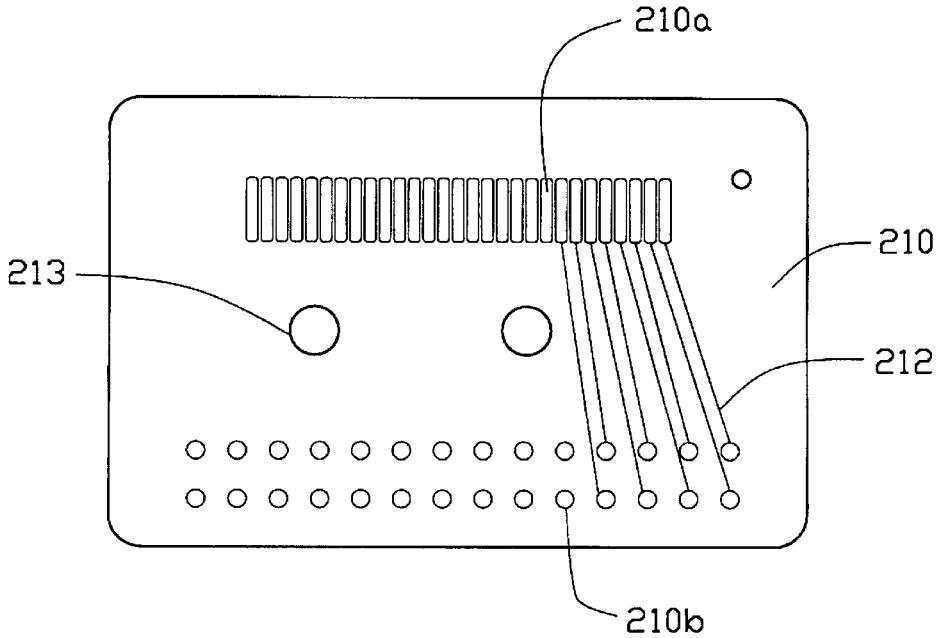
FIG. 7 is a top plan view of a printed circuit board used in the cable assembly of FIG. 4.
Figure 8:
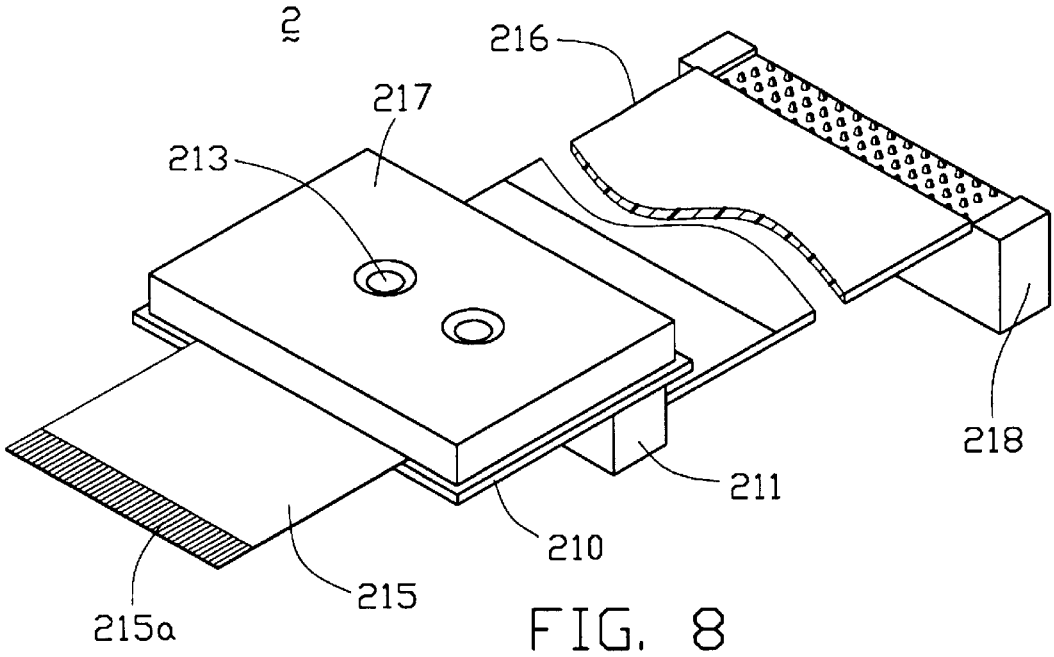
FIG. 8 is a perspective view of FIG. 4.
Figure 9:
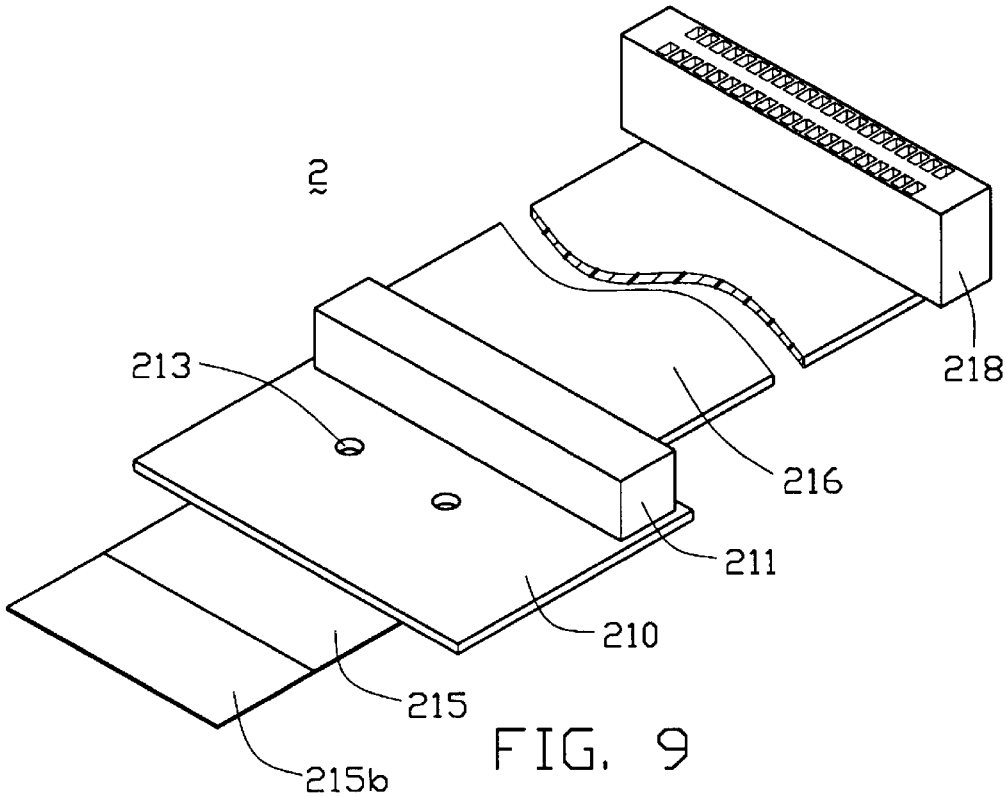
FIG. 9 is still a perspective view of FIG. 4 viewed from a reverse direction.

Referring to FIGS. 1, 2 and 3, a transition cable assembly 1 in accordance with a first embodiment of the present invention comprises a flexible circuit 10 having a connecting portion 11 at one end and a socket connector 12 at another end for mating with a complimentary connector (not shown). The flexible circuit 10 defines a pair of holes 13 adjacent to the connecting portion 11 for extension of a locking screw (not shown) retained to a hard disk drive (not shown). A strain relief 14 is assembled to the flexible circuit 10 adjacent to the holes 13 thereby increasing the rigidity thereof.

The strain relief 14 includes upper and lower or first and second plates 14*a*, 14*b* to sandwich the flexible circuit 10 therebetween. By this arrangement, the stiffness of the flexible circuit 10 around the holes 13 can be increased thereby preventing the flexible circuit 10 from breaking apart resulted from force concentration when the locking screws are assembled thereto.

Referring to FIGS. 4, 5, 6, 7, 8 and 9, a transition cable assembly 2 in accordance with a second embodiment of the present invention comprises a substrate 210 having a connecting section or golden finger 210*a* at one edge and a 28 holes array 210*b* electrically connected to the connecting section 210*a* by leads 212 at another edge whereby two holes 210*b* are bypassed. The connecting section 210*a* is embodied to 26 golden fingers. A socket connector 211 is soldered to the holes 210*b* in another connecting section opposite to the connection section 210*a*. A 26 conductors FFC cable 215 is electrically soldered to those 26 golden fingers 210*a* of the substrate 210. A connecting end 215*a* of the FFC cable 215 is inserted into a built-in FFC connector of a hard disk drive (not shown). The connecting end 215*a* is reinforced by a backing plate 215*b* to increase its rigidity thereof. The substrate 210 defines a pair of holes 213 therein for extension of locking screws (not shown). A 28-wire cable 216 is electrically connected to the socket connector 211, preferably by termination to insulation displacement sections of the socket connector 211 (not shown). A receptacle connector 218 is connected to the other end of the cable 216 for connection with an electrical device (not shown). In order to protect connections between the conductors of the FFC cable 215 and the golden fingers 210*a* from breaking apart, an insulative layer 217 is deployed over the substrate 210 such that the connections are completely protected. The insulative layer 217 is formed by a hot melt glue. By this arrangement, the connections between the substrate 210 and the FFC cable 215 are further enhanced.

It can be noted that in comparison with the prior art, the invention uses a reinforcement plate, e.g., the strain relief 14 in the first embodiment and the substrate 210 in the second embodiment, defining a pair of holes for reliable securement to the hard disk by screws. Because FFC or FPC(Flexible Printed Circuit) is more expensive than the traditional ribbon cable, in the second embodiment the traditional inexpensive ribbon cable 216 substitutes thereof. Another further improved embodiment can be referred to the copending application Ser. No. 09/181,040 filed Oct. 27, 1998.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. A transition cable assembly, comprising:

a substrate having a connection section with a first number of conductive position at one edge thereof and a connector assembled to the substrate at another edge and having a second number of conductive positions wherein the second number is different from the first number, said connector being electrically connected to said connection section by leads, wherein at least one position of the connector is bypassed, said substrate defining at least a hole therein;

a first cable mechanically and electrically assembled to said connector;

a second cable mechanically and electrically connected to said connection section of said substrate; and an insulative layer deployed on said substrate to cover connections between said second cable and said connection section.

2. The assembly as recited in claim 1, wherein said insulative layer is a layer of hot melt glue.

3. A transition cable assembly comprising:

a substrate defining a first connection section and an opposite second connection section, and at least a hole for mechanical securement;

a first cable having an end mechanically and electrically connected to said first connection section and another end; and a second cable having an end electrically connected to said second connection section through a connector and another end, wherein in comparison with each other, the first cable is shorter and more expensive while the second cable is longer and inexpensive, and the first cable is a 26 conductors FFC cable and the second cable is a 28-wire cable.

* * * * *